US009163649B2

(12) United States Patent
Casavant et al.

(10) Patent No.: US 9,163,649 B2
(45) Date of Patent: Oct. 20, 2015

(54) MECHANICAL STOP ADJUSTMENT FOR JACK

(71) Applicant: General Electric Company, Schenectady, NY (US)

(72) Inventors: Matthew Stephen Casavant, Greenville, SC (US); Kenneth Damon Black, Travelers Rest, SC (US)

(73) Assignee: General Electric Company, Schenectady, NY (US)

( * ) Notice: Subject to any disclaimer, the term of this patent is extended or adjusted under 35 U.S.C. 154(b) by 480 days.

(21) Appl. No.: 13/653,011

(22) Filed: Oct. 16, 2012

(65) Prior Publication Data

US 2014/0102290 A1 Apr. 17, 2014

(51) Int. Cl.
*F15B 15/26* (2006.01)
*F15B 15/24* (2006.01)

(52) U.S. Cl.
CPC ..... *F15B 15/24* (2013.01)

(58) Field of Classification Search
CPC ..... F15B 15/1447; F15B 15/24; F16J 1/12
USPC ..... 92/13, 29, 79, 255
See application file for complete search history.

(56) References Cited

U.S. PATENT DOCUMENTS

| | | | | |
|---|---|---|---|---|
| 3,232,182 | A * | 2/1966 | Gilbert | 92/13.41 |
| 3,407,710 | A * | 10/1968 | Weiss | 92/13.8 |
| 3,683,752 | A * | 8/1972 | Martin | 92/13.51 |
| 4,630,529 | A * | 12/1986 | Tijs | 92/13 |
| 4,838,393 | A | 6/1989 | Mourray et al. | |
| 2009/0104047 | A1 | 4/2009 | Baus et al. | |

FOREIGN PATENT DOCUMENTS

DE 19942273 A1 * 4/2001 ..... F15B 15/24

OTHER PUBLICATIONS

U.S. Appl. U.S. Appl. No. 13/492,297, filed Jun. 8, 2012.

* cited by examiner

*Primary Examiner* — Dwayne J White
*Assistant Examiner* — Matthew Wiblin
(74) *Attorney, Agent, or Firm* — Ernest Cusick; Hoffman Warnick LLC

(57) ABSTRACT

A first adjustable stop on a jack member selectively adjusts an incline stop gap while a second adjustable stop on a support element selectively adjusts a decline stop gap. Stop surfaces on the first adjustable stop and the support element may define the incline stop gap, while stop surfaces on the second adjustable stop and the first adjustable stop may define the decline stop gap. A number of turns of a stop needed to effect a desired of adjustment may be determined using a pitch, lead, and/or number of starts of threads used to mount the stops.

20 Claims, 5 Drawing Sheets

MECHANICAL STOP ADJUSTMENT FOR JACK

BACKGROUND OF THE INVENTION

The disclosure relates generally to adjustment and control of a jack, and more particularly to adjustment and control of stop gaps in a hydraulic jack.

In the assembly and/or disassembly of double-wall gas turbine casing assemblies, roller jacks may be employed to move portions of the assemblies. For example, a lower half of a casing assembly may be supported on roller jacks after removal of the upper half for access to the interior of the gas turbine. Because typical double-wall casing assemblies are very heavy, the roller jacks that are employed are usually hydraulic jacks, which can handle very large loads despite being relatively small and easy to handle. However, fine tuning the positioning of a hydraulic jack can be difficult, which may lead to improper alignment and/or damage of tight assembly clearance parts of gas turbines with which they are used. For example, overshoot during extension of a hydraulic jack may cause a collision of the casing into a turbine blade tip. In addition, hydraulic jacks have a tendency to retract under load if left extended for a period of time so that repositioning may become necessary if a user leaves the jack to adjust another portion of the casing assembly.

BRIEF DESCRIPTION OF THE INVENTION

Embodiments of the invention disclosed herein may take the form of an apparatus for adjusting a jack stop with a first adjustable stop mountable on a first jack member of a jack and including a first stop surface. The first jack member has a longitudinal axis, and the first adjustable stop includes a first adjustment feature that prohibits travel of the first stop surface relative to the first jack member along the longitudinal axis responsive to force exerted on at least one of the first adjustable stop or the first jack member along the longitudinal axis. The first adjustment feature also selectively induces adjustment of a position of the first stop surface relative to the first jack member. The apparatus also includes a support element in which a second adjustable stop can be mounted, the second adjustable stop including a second stop surface. The second adjustable stop can also include a second adjustment feature that prohibits travel of the second stop surface relative to the support element along the longitudinal axis responsive to force exerted on at least one of the second adjustable stop or the support element along the longitudinal axis. The second adjustment feature also selectively induces adjustment of a position of the second stop surface relative to at least one of the first stop surface or the support element.

Embodiments of the invention may also take the form of an apparatus for adjusting stop gaps of a jack, the apparatus including a first adjustable stop selectively mounted on a first jack member of a jack, the first adjustable stop including a first stop surface. A support element can include a second stop surface opposed to the first stop surface, a distance between the first stop surface and the second stop surface being a first stop gap. The first adjustable stop can further include a first adjustment feature that interacts with a second adjustment feature of the first jack member to prohibit a change in the first stop gap responsive to an axial force exerted on at least one of the first adjustable stop and the first jack member along a longitudinal axis of the first jack member while selectively adjusting the first stop gap. The apparatus can also include a second adjustable stop selectively mounted on the support element and having a third stop surface. A fourth stop surface opposed to the third stop surface can be included on the first adjustable stop, a distance between the third stop surface and the fourth stop surface being a second stop gap. The second adjustable stop can include a third adjustment feature that interacts with a fourth adjustment feature of the second member to prohibit a change in the second stop gap responsive to an axial force exerted on at least one of the second adjustable stop or the support element along the longitudinal axis. The second adjustable stop also selectively adjusts the second stop gap.

Another embodiment may include a method of adjusting a jack with an apparatus including a first adjustable stop mounted on a first jack member, a support element, a second adjustable stop mounted in the support element, first and second opposed stop surfaces on the first adjustable stop and the support element, respectively, and third and fourth opposed stop surfaces on the second adjustable stop and the first adjustable stop, respectively. The method can include bringing the first stop surface into engagement with the second stop surface using the first adjustable stop and then moving the first stop surface away from the second stop surface by a first desired amount of travel using the first adjustable stop. In addition, the method can include bringing the third stop surface into engagement with the fourth stop surface using the second adjustable stop; and moving the third stop surface away from the fourth stop surface by a second desired amount of travel using the second adjustable stop.

The above described and other features are exemplified by the following detailed description.

BRIEF DESCRIPTION OF THE DRAWING

These and other features of the disclosure will be more readily understood from the following detailed description of the various aspects of the invention taken in conjunction with the accompanying drawings that depict various aspects of the invention.

It is noted that the drawings may not be to scale. The drawings are intended to depict only typical aspects of the invention, and therefore should not be considered as limiting the scope of the invention. In the drawings, like numbering represents like elements between the drawings.

The detailed description explains embodiments of the invention, together with advantages and features, by way of example with reference to the drawings.

DETAILED DESCRIPTION OF THE INVENTION

As used herein, "decline" describes a direction of and elements related to retraction of a load-bearing jack member and "incline" describes a direction of and elements related to extension of the load-bearing jack member. Thus, a "decline stop" is a stop that limits retraction of the load-bearing jack member, and an "incline stop" is a stop that limits extension of the load-bearing jack member. Similarly, a "decline direction" is a direction in which the load-bearing member retracts, and an "incline direction" is a direction in which the load-bearing member extends.

Figure 1:
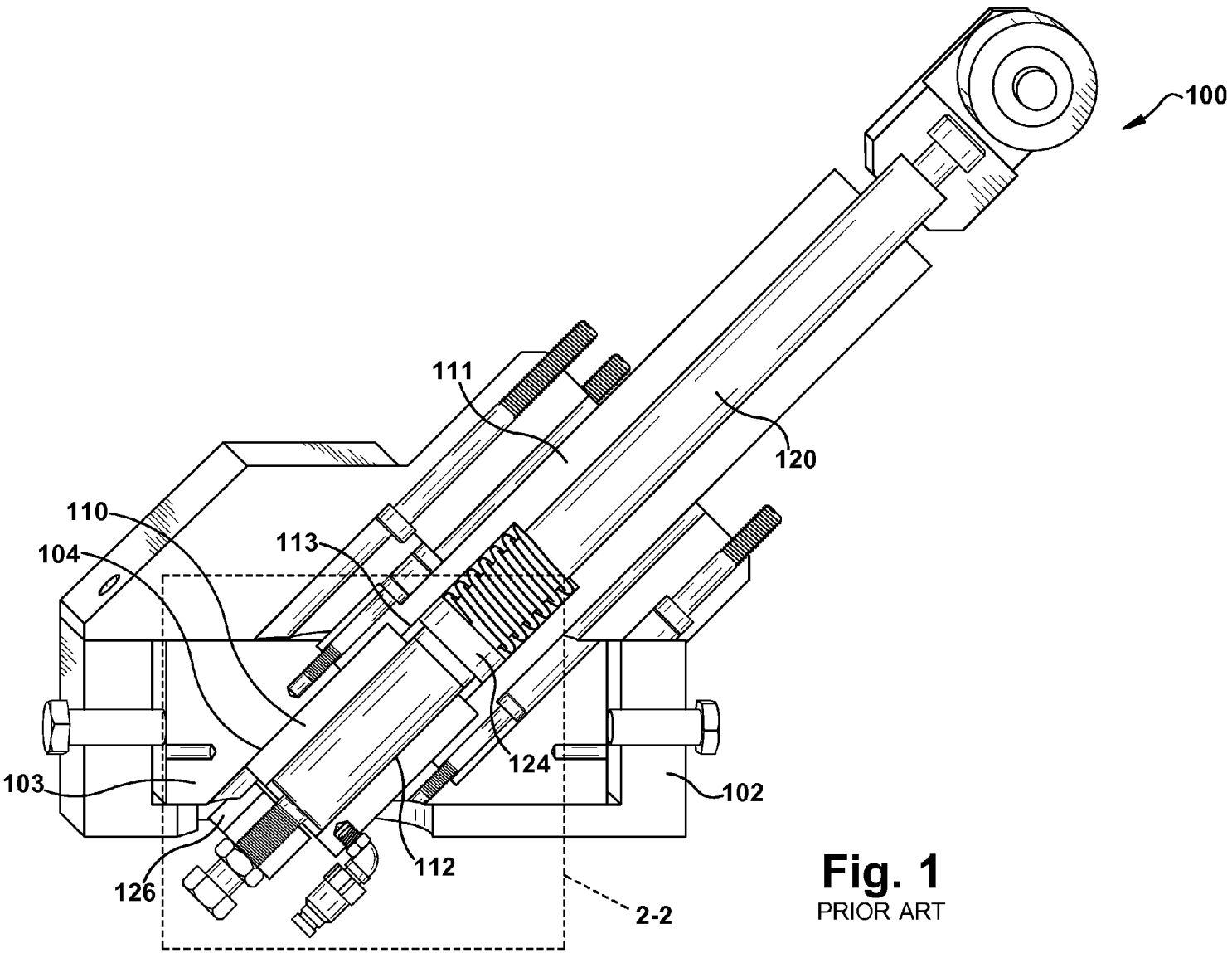
Fig. 1 PRIOR ART
FIG. 1 shows a schematic diagram of a prior art hydraulic jack to which embodiments of the invention disclosed herein may be applied.
Figure 2:
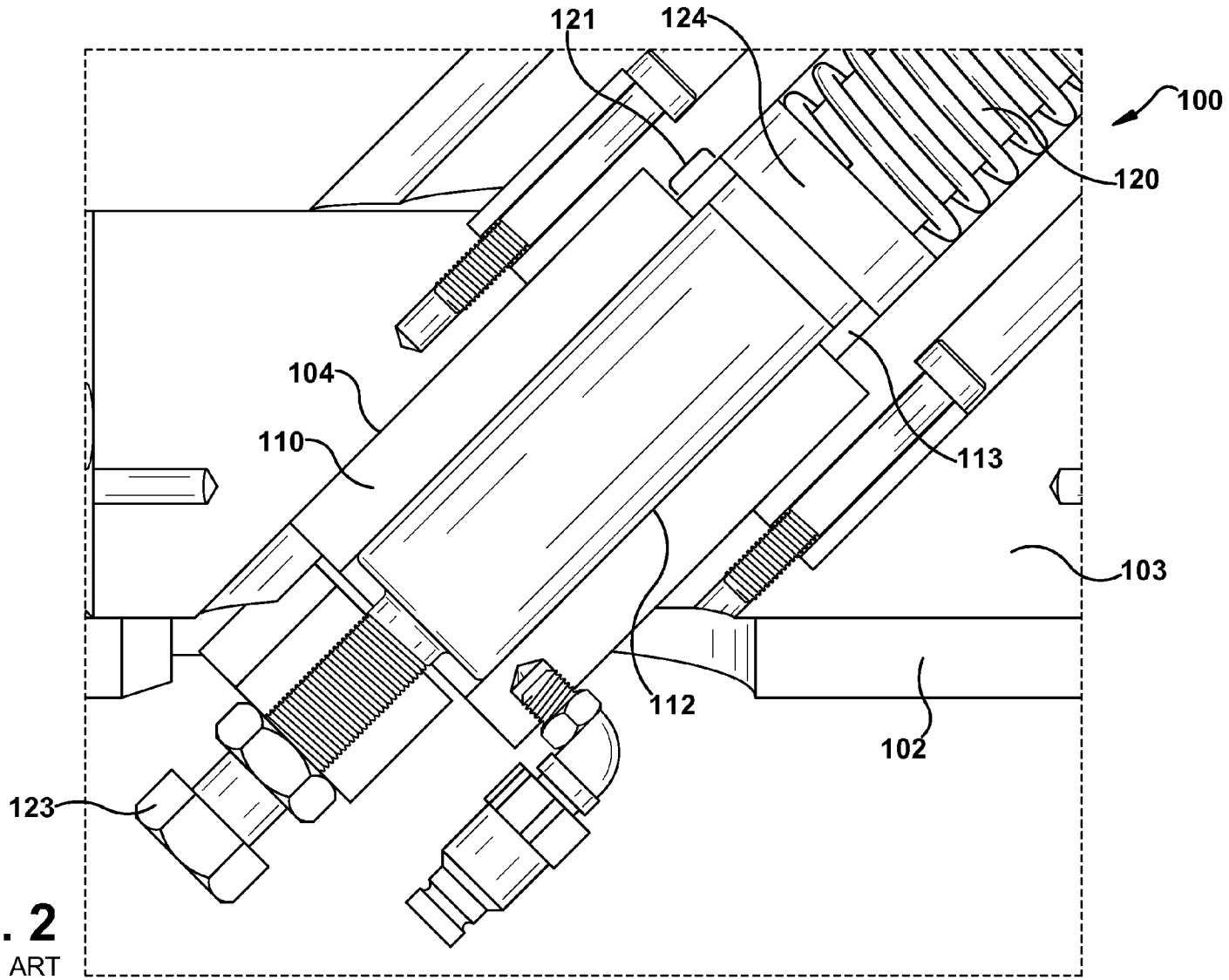
Fig. 2 PRIOR ART
FIG. 2 shows a schematic diagram of a detail 2-2 of the prior art hydraulic jack shown in FIG. 1.

To illustrate the improvement provided by embodiments of the invention disclosed herein, an example of a typical prior art jack 100, in this case a hydraulic jack, is shown in FIG. 1, as well as in FIG. 2 showing detail 2-2 of FIG. 1. A housing 102 of jack 100 may include an adjustable block 103 having a bore 104 in which a mechanical stop 110 and an outer jack cylinder 111 may be mounted. A portion of an inner jack cylinder 120 may travel in an axial bore 112 in mechanical stop 110 responsive to actuation, such as by a hydraulic actuation via a change in fluid volume in a chamber 113. Mechanical stop 110 is arranged such that it prevents travel of inner cylinder 120 beyond a decline stop point enforced by interaction between mechanical stop 110 and a flange 124 of inner cylinder 120. A decline stop gap 121 is a distance between mechanical stop 110 and flange 124 and may be adjusted with nut 123. However, no incline stop is provided for inner cylinder 120, which can increase difficulty of accurate positioning of a load when moving inner cylinder 120 in an incline direction.

Aspects of the invention provide an apparatus for adjusting a jack, particularly stop gaps of a jack, such as with a two-way externally accessible mechanical stop adjustment apparatus. Embodiments of the invention disclosed herein allow adjustment of an incline stop gap as well as a decline stop gap of a jack so that travel of the jack may be controlled with a high degree of accuracy. Adjustment features, such as threads, on parts of the arrangement interact to allow relative axial position adjustment while otherwise preventing relative axial motion. Using at least one of a pitch, a lead, or a number of starts of threads used in the apparatus, an amount of rotation of an adjustable stop to achieve a desired change in a respective stop gap, such as a number of turns per unit of distance, may be determined and used to set a maximum incline stop gap and/or a maximum decline stop gap.

Figure 3:
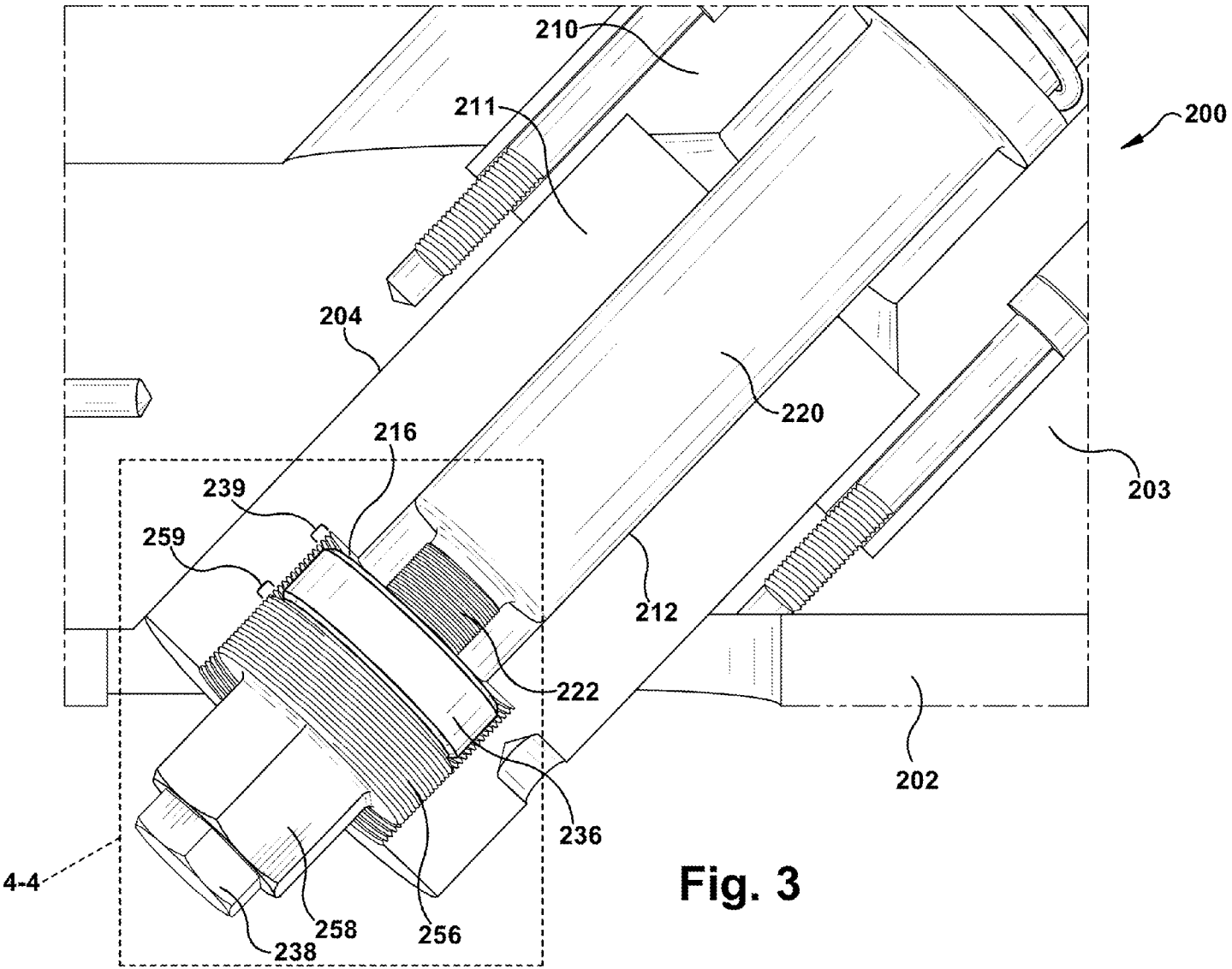
FIG. 3 shows a schematic perspective diagram of a hydraulic jack including a two-way externally accessible mechanical stop adjustment arrangement according to embodiments of the invention disclosed herein.
Figure 4:
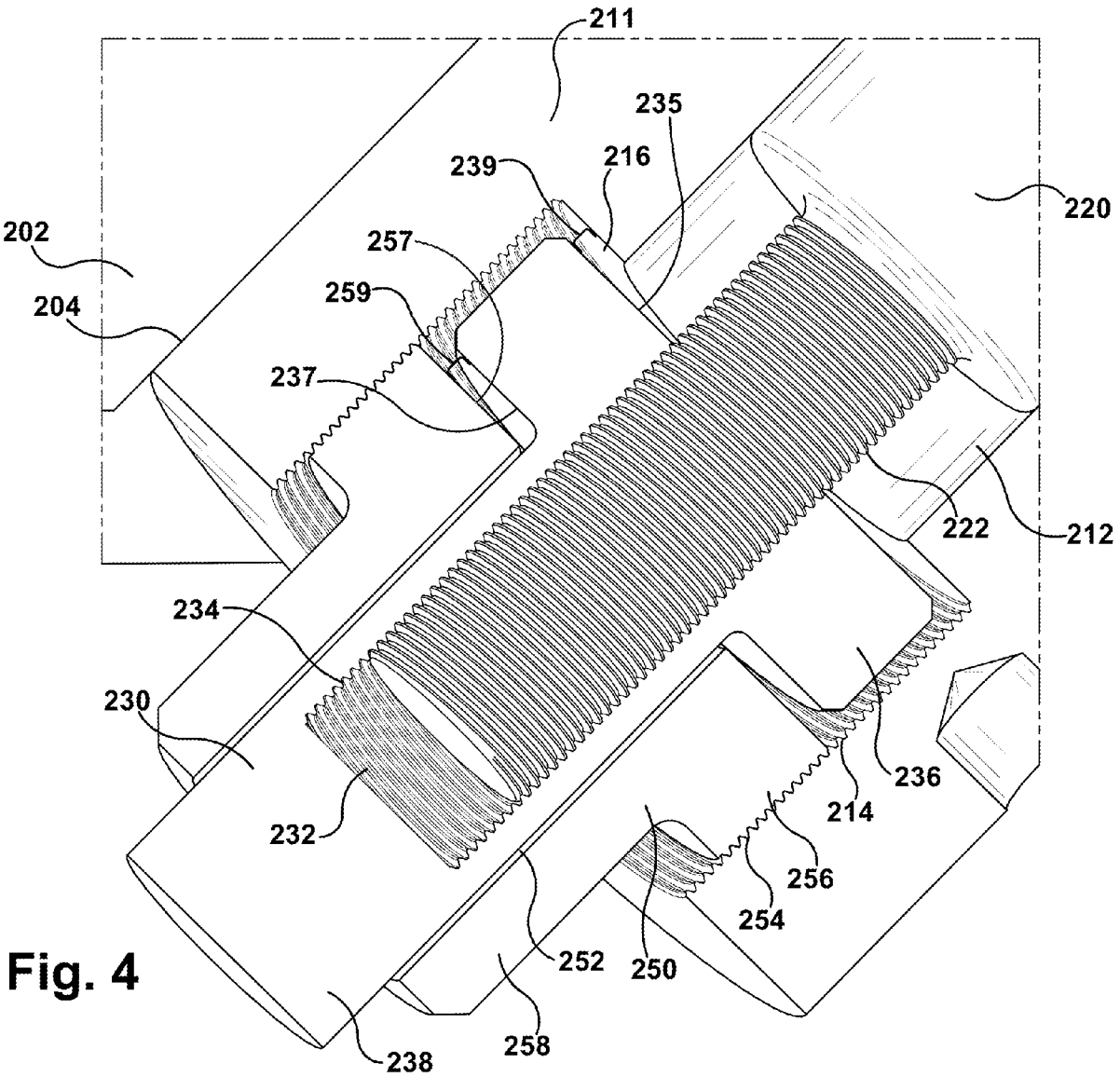
FIG. 4 shows a schematic cross sectional detail 4-4 of the hydraulic jack shown in FIG. 3.

With reference to FIG. 3, as well as to FIG. 4 showing detail 4-4 of FIG. 3, an example of a jack 200 including an embodiment of the invention is shown. A first jack member, such as an inner cylinder 220, may be supported by at least one of a support element 210, such as a mechanical stop, or a second jack member, such as an outer cylinder 211, so that the first jack member may travel along its longitudinal axis relative to support element 210 and/or outer cylinder 211. For example, a housing 202 of jack 200 may include a bore 204 in which support element 210 may be supported and constrained against motion. In embodiments, support element 210 may be attached to the second jack member, though support element 210 may be a portion of the second jack member in other embodiments. Support element 210 and/or outer cylinder 211 may include an axial bore 212 in which inner jack cylinder 220 may be supported for relative axial travel responsive to actuation, such as with a hydraulic actuation arrangement (not shown). For example, an outer surface of inner jack cylinder 220 may engage and slide against an inner surface of axial bore 212.

A first adjustable stop, such as an inner bushing 230, may be provided to allow adjustment of a first stop gap 239, while a second adjustable stop, such as an outer bushing 250, may be provided to allow adjustment of a second stop gap 259. The first adjustable stop may include a first adjustment feature arranged to interact with a second adjustment feature of the first jack member so as to prohibit relative travel between the first jack member and the first adjustable stop responsive to a force applied along the longitudinal axis of the first jack member, such as a load to which the jack is applied or an actuation force, while selectively adjusting relative position or inducing relative travel responsive to another action, such as rotation of inner bushing 230. For example, inner bushing 230 may have an axial bore 232 into which a portion of inner cylinder 220, such as threaded portion 222, may project. The first adjustment feature may include at least one internal thread 234 formed on an internal surface of bore 232, and the second adjustment feature may include at least one corresponding external thread on portion 222.

Similarly, the second adjustable stop may include a third adjustment feature arranged to interact with a fourth adjustment feature of support element 210 so as to prohibit relative travel between the second adjustable stop and support element 210 responsive to a force applied along the longitudinal axis of the first jack member, while selectively adjusting relative position or inducing relative travel responsive to another action, such as rotation of outer bushing 250. For example, outer bushing 250 may have an axial bore 252 in which inner bushing 230 may be supported and/or may travel axially. In embodiments, a portion of inner bushing 230 may engage and slide against an internal surface of axial bore 252, though other arrangements may be employed as may be desired and/or suitable. In addition, outer bushing 250 may bear the third adjustment feature in the form of at least one external thread 254, such as on a decline stop flange 256, arranged to engage the fourth adjustment feature in the form of an internally threaded portion 214 of support element axial bore 212.

In the example shown in FIGS. 3 and 4, inner bushing 230 may include a flange 236 or the like that may include a first stop surface 235. Threaded portion 214 of support element axial bore 212 may in embodiments have a larger inner diameter than the portion of axial bore 212 in which inner jack cylinder slides so that a shoulder or incline stop 216 may be formed, at least a portion of which may be construed as a second stop surface opposed to first stop surface 235 that may limit travel of inner jack cylinder 230 in one direction, such as an incline direction. As used herein, "incline direction" means a direction in which inner cylinder 220 travels out of or extends from jack 200. Additionally, flange 236 may be arranged to engage decline stop flange 256 of outer bushing 250 to limit travel of inner jack cylinder 230 in an opposite direction, such as a decline direction. As used herein, "decline direction" means a direction in which inner cylinder travels or retracts toward jack 200. For example, decline stop flange 256 may include a third stop surface 257 facing an opposed fourth stop surface 237 on inner bushing flange 236 to limit travel of inner cylinder 220. Thus, inner jack cylinder 230 may only travel between an incline stop position at which flange 236 engages shoulder or incline stop 216, and a decline stop position at which flange 236 engages decline stop flange 256. In the incline stop position, first stop surface 235 engages the second stop surface on incline stop 216, while in the decline stop position, third stop surface 257 engages fourth stop surface 237. A distance between the first and second stop surfaces is an incline stop gap 239, while a distance between the third and fourth stop surfaces is a decline stop gap 259. By sizing flange 236, adjusting a position of flange 236 on threaded portion 222, and adjusting a position of decline stop flange 256, a maximum incline stop gap 239 may be fine-tuned, as may a maximum decline stop gap 259, so that inner cylinder 220 will not extend or retract more than desired. Using at least a pitch, a lead, and/or a number of starts of internal thread(s) 234 and/or external thread(s) 254, a number of turns of inner bushing 230 and/or outer bushing 250 to achieve a desired maximum incline stop gap 239 and/or maximum decline stop gap 259 may be determined with a high degree of accuracy.

To allow adjustment of inner bushing flange 236 and decline stop flange 256, embodiments provide an end portion 238 of inner bushing 230 that is accessible from outside of jack 200, as well as an end portion 258 of outer bushing 250 that is accessible from outside of jack 200. For example, one or both end portions 238, 258 may include a feature, such as a polygonal hole or outer surface cross section, to facilitate use of a wrench or another tool to rotate a respective bushing 230, 250.

Figure 5:
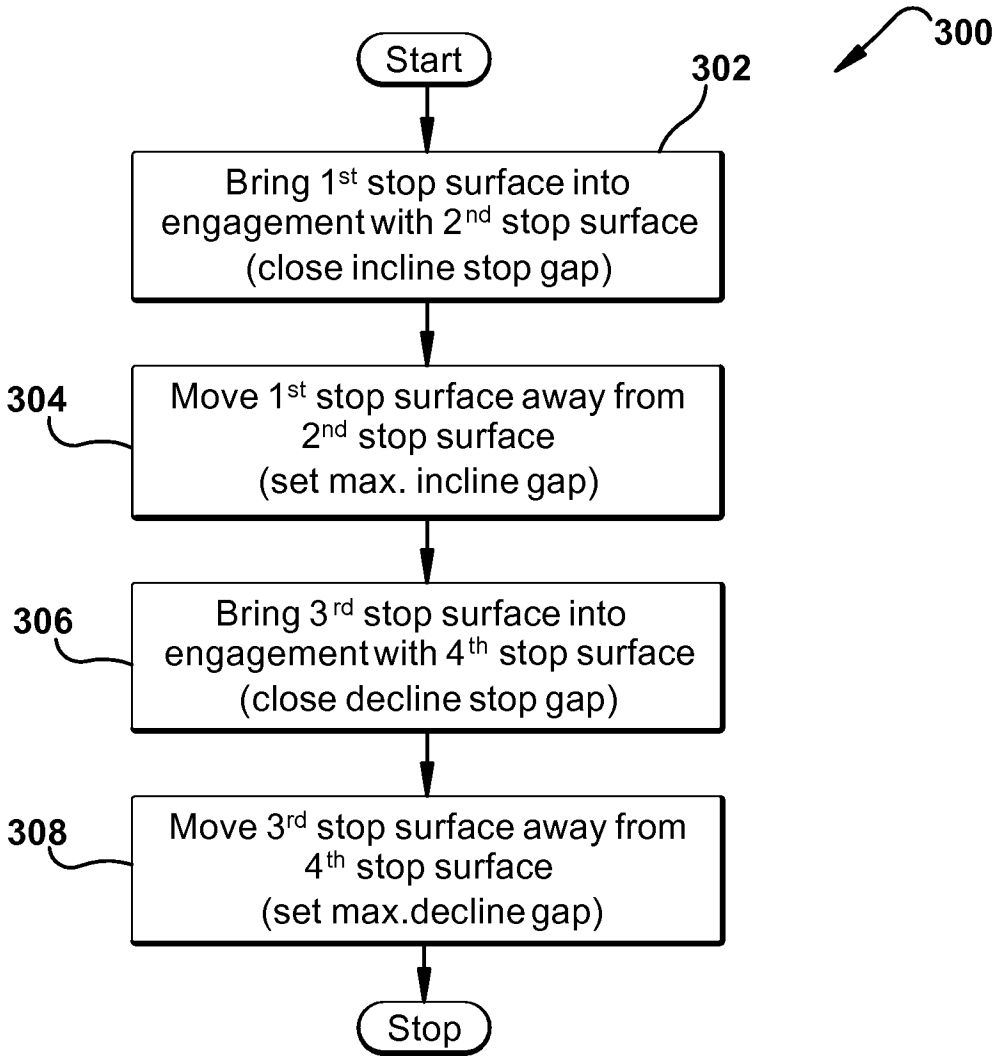
FIG. 5 shows a schematic flow diagram of a method of stop gap adjustment according to embodiments of the invention disclosed herein.

A method 300 of adjusting a jack according to embodiments is shown in the illustrative flow diagram of FIG. 5. In embodiments, method 300 may be performed in an apparatus including a first adjustable stop mounted on a first jack member, a support element, a second adjustable stop mounted in the support element, first and second opposed stop surfaces on the first adjustable stop and the support element, respectively, and third and fourth opposed stop surfaces on the second adjustable stop and the first adjustable stop, respectively, such as the example described above and shown in FIGS. 3 and 4. Adjustment of a jack may broadly include closing a first stop gap, setting a maximum value of the first stop gap, closing a second stop gap, and setting a maximum value of the second stop gap. More specifically, adjustment may begin by bringing the first stop surface into engagement with the second stop surface (block 302), such as by rotating inner bushing 230 to move flange 236 into engagement with incline stop 216 (FIGS. 3 and 4). The first stop surface may then be moved away from the second stop surface by a first desired amount or distance of travel using the first adjustable stop (block 304), which may set a desired maximum incline stop gap. For example, inner bushing 230 may be rotated to move flange 236 a desired amount or distance of travel away from incline stop 216 to set a maximum value of incline stop gap 239 (FIGS. 3 and 4). A number of turns or fractions thereof of inner bushing 230 needed to achieve the first desired amount or distance of travel may be determined using at least one of a pitch, a lead, and/or a number of starts of thread(s) 234. The third stop surface may then be brought into engagement with the fourth stop surface using the second adjustable stop (block 306), such as by rotating outer bushing 250 to move decline stop 256 into engagement with flange 236. Moving the third stop surface away from the fourth stop surface by a second desired amount or distance of travel using the second adjustable stop (block 308) may set a desired maximum decline stop gap. For example, outer bushing 250 may be rotated to move decline stop 256 away from flange 236 by a desired distance. A number of turns or fractions thereof of outer bushing 250 needed to achieve the second amount or distance of travel may be determined using at least one of a pitch, a lead, and/or a number of starts of thread(s) 254.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus for adjusting a jack, the apparatus comprising:

a first adjustable stop mountable on a first jack member of a jack and including a first stop surface, the first jack member having a longitudinal axis, the first adjustable stop including a first adjustment feature that prohibits travel of the first stop surface relative to the first jack member along the longitudinal axis responsive to force exerted on at least one of the first adjustable stop or the first jack member along the longitudinal axis, the first adjustment feature also selectively adjusting a position of the first stop surface relative to the first jack member along the longitudinal axis, wherein the first adjustment feature includes at least one thread on the first adjustable stop that mates with a respective corresponding thread on the first jack member and including a first end portion for adjusting that is accessible from an area outside of the jack;

a support element; and a second adjustable stop mounted on the support element and including a second stop surface, the second adjustable stop including a second adjustment feature that prohibits travel of the second stop surface relative to the support element along the longitudinal axis responsive to axial force exerted on at least one of the second adjustable stop or the support element along the longitudinal axis, the second adjustment feature also selectively adjusting a position of the second stop surface relative to at least one of the first stop surface or the support element along the longitudinal axis, wherein the second adjustment feature includes at least one thread on the second adjustable stop that mates with a respective corresponding thread on the support element and including a second end portion for adjusting that is accessible from an area outside of the jack;

wherein the first end portion and the second end portion protrude outside of the support element.

2. The apparatus of claim 1, wherein the at least one thread on the first adjustable stop that mates with the respective corresponding thread on the first jack member comprises at least one of a pitch, a lead, or a number of starts of the threads being selected to prohibit the travel between the first stop surface and the first jack member responsive to axial force and so that rotation of the first adjustable stop adjusts the axial position of the first stop surface relative to the first jack member.

3. The apparatus of claim 2, wherein an amount of rotation corresponding to a desired position of the first stop surface is determined based on at least one of the pitch, the lead, or the number of starts of the threads on the first adjustable stop and the first jack member.

4. The apparatus of claim 1, wherein the at least one thread on the second adjustable stop that mates with the respective corresponding thread on the support element comprises at least one of a pitch, a lead, or a number of starts of the threads being selected to prohibit the travel between the second stop surface and the support element along the longitudinal axis responsive to axial force and so that rotation of the second adjustable stop adjusts the axial position of the second stop surface relative to the support element.

5. The apparatus of claim 4, wherein an amount of rotation corresponding to a desired position of the second stop surface is determined based on at least one of the pitch, the lead, or the number of starts of the threads on the second adjustable stop and the support element.

6. The apparatus of claim 1, wherein the first jack member includes an inner cylinder of a hydraulic jack and the first adjustable stop is an incline stop.

7. The apparatus of claim 1, wherein the support element includes one of a mechanical stop or an outer cylinder of hydraulic jack and the second adjustable stop is a decline stop.

8. An apparatus for adjusting stop gaps of a jack, the apparatus comprising:

a first adjustable stop selectively mounted on a first jack member of a jack and including a first stop surface;

a support element including a second stop surface opposed to the first stop surface, a distance between the first stop surface and the second stop surface being a first stop gap;

the first adjustable stop further including a first adjustment feature that interacts with a second adjustment feature of the first jack member to prohibit a change in the first stop gap responsive to an axial force exerted on at least one of the first adjustable stop and the first jack member along a longitudinal axis of the first jack member while selectively adjusting the first stop gap, wherein the first adjustment feature includes at least one first thread and the second adjustment feature includes at least one corresponding second thread and including a first end portion for adjusting that is accessible from an area outside of the apparatus;

a second adjustable stop selectively mounted on the support element and including a third stop surface;

a fourth stop surface on the first adjustable stop and opposed to the third stop surface, a distance between the third stop surface and the fourth stop surface being a second stop gap; and the second adjustable stop including a third adjustment feature that interacts with a fourth adjustment feature of the second member support element to prohibit a change in the second stop gap responsive to an axial force exerted on at least one of the second adjustable stop and the support element along the longitudinal axis while selectively adjusting the second stop gaps wherein the third adjustment feature includes at least one third thread on the second adjustable stop and the fourth adjustment feature includes at least one corresponding fourth thread on the support element and including a second end portion for adjusting that is accessible from an area outside of the apparatus;

wherein the first end portion and the second end portion protrude outside of the support element.

9. The apparatus of claim 8, wherein the at least one first thread and the at least one corresponding second thread comprises at least one of a pitch, a lead, or a number of starts of each thread prohibiting change in the first stop gap by prohibiting relative travel between the first stop surface and the second stop surface along the longitudinal axis responsive to axial force and allowing relative travel along the longitudinal axis responsive to rotation of the first adjustor adjustable stop.

10. The apparatus of claim 9, wherein the first adjustable stop includes an inner bushing having a bore with an internal surface carrying the at least one first thread.

11. The apparatus of claim 8, wherein the at least one third thread on the second adjustable stop and the at least one corresponding fourth thread on the support element comprises at least one of a pitch, a lead, or a number of starts of each thread prohibiting change in the second stop gap responsive to axial force by prohibiting relative travel between the third stop surface and the fourth stop surface along the longitudinal axis and allowing relative travel along the longitudinal axis responsive to rotation of the second adjustable stop.

12. The apparatus of claim 11, wherein the second adjustable stop includes an outer bushing mounted in a bore in the support element, an external surface of the outer bushing includes the at least one third thread, and an internal surface of the support element bore includes the at least one fourth thread.

13. The apparatus of claim 8, wherein the first jack member includes an inner cylinder of the hydraulic jack, the support element includes one of a mechanical stop of a hydraulic jack or an outer cylinder of a hydraulic jack, and the first adjustable stop and the second adjustable stop each have a longitudinal axis that is coaxial with the longitudinal axis of the inner cylinder.

14. The apparatus of claim 13, wherein:

the first adjustable stop includes an inner bushing;

the second adjustable stop includes an outer bushing;

the inner bushing extends through a bore in the outer bushing;

the first adjustment feature includes at least one first thread on an internal surface of a bore in the inner bushing;

the second adjustment feature includes at least one corresponding second thread on an external surface of the first jack member;

at least one of a pitch, a lead, or a number of starts of each first and second thread prohibiting the relative travel between the first stop surface of inner bushing and the first jack member responsive to axial force and allowing relative travel responsive to rotation of the inner bushing;

the third adjustment feature includes at least one third thread on an external surface of the outer bushing;

the fourth adjustment feature includes at least one corresponding fourth thread on an internal surface of a bore in the support element; and at least one of a pitch, a lead, or a number of starts of each third and fourth thread prohibiting the relative travel between the fourth stop surface and the support element responsive to axial force and allowing relative travel responsive to rotation of the outer bushing.

15. The apparatus of claim 8, wherein the first stop gap is an incline stop gap and the second stop gap is a decline stop gap.

16. In an apparatus for adjusting a jack, the apparatus including a first adjustable stop mounted on a first jack member, corresponding first and second threads on the first adjustable stop and the first jack member and including a first end portion for adjusting that is accessible from an area outside of the jack, a support element, a second adjustable stop mounted in the support element, corresponding third and fourth threads on the second adjustable stop and the support element and including a second end portion for adjusting that is accessible from an area outside of the jack, first and second opposed stop surfaces on the first adjustable stop and the support element, respectively, and third and fourth opposed stop surfaces on the second adjustable stop and the first adjustable stop, respectively, wherein the first end portion and the second end portion protrude outside of the support element; a method of adjusting the jack comprising:

bringing the first stop surface into engagement with the second stop surface using the first adjustable stop;

moving the first stop surface away from the second stop surface by a first desired amount of travel using the first adjustable stop;

bringing the third stop surface into engagement with the fourth stop surface using the second adjustable stop; and moving the third stop surface away from the fourth stop surface by a second desired amount of travel using the second adjustable stop.

17. The method of claim 16, wherein the bringing the first stop surface into engagement with the second stop surface includes rotating the first adjustable stop in a first direction.

18. The method of claim 17, wherein:

the corresponding first and second threads on the first adjustable stop and the first jack member, respectively, include at least one of a respective pitch, a respective lead, and a respective number of starts selected to prohibit relative travel between the first and second stop surfaces responsive to a load exerted on the first jack member; and the moving the first stop surface away from the second stop surface by a first desired amount of travel includes:

determining a first amount of relative rotation between the first and second threads to achieve the first desired amount based on at least one of the respective pitch, the respective lead, or the respective number of starts of the first and second threads; and rotating the first adjustable stop in a second direction by the first amount of relative rotation.

19. The method of claim 16, wherein the bringing the third stop surface into engagement with the fourth stop surface includes rotating the second adjustable stop in a third direction.

20. The method of claim 19, wherein:

the corresponding third and fourth threads on the second adjustable stop and the support element, respectively, include at least one of a respective pitch, a respective lead, and a respective number of starts selected to prohibit relative travel between the third and fourth stop surfaces responsive to a load exerted on the first jack member; and the moving the third stop surface away from the fourth stop surface by a second desired amount of travel includes:

determining a second amount of relative rotation between the third and fourth threads to achieve the second desired amount based on at least one of the respective pitch, the respective lead, or the respective number of starts of the first and second threads; and rotating the second adjustable stop in a fourth direction by the second amount of relative rotation.

* * * * *